US006349649B1

(12) United States Patent
Jacoby et al.

(10) Patent No.: US 6,349,649 B1
(45) **Date of Patent: *Feb. 26, 2002**

(54) PERFORATING DEVICES FOR USE IN WELLS

(75) Inventors: Jerome J. Jacoby, Grass Valley, CA (US); James E. Brooks, Manvel; Clifford L. Aseltine, deceased, late of Houston, both of TX (US), by Margaret Lynn Aseltine, executrix

(73) Assignees: Schlumberger Technology Corp., Sugar Land, TX (US); Regents of Univ. of California, Oakland, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/394,792

(22) Filed: Sep. 13, 1999

Related U.S. Application Data

(60) Provisional application No. 60/100,233, filed on Sep. 14, 1998.

(51) Int. Cl.[7] ..... F42B 1/02
(52) U.S. Cl. ..... 102/307; 102/306; 102/476
(58) Field of Search ..... 102/306, 307, 102/476

(56) References Cited

U.S. PATENT DOCUMENTS

| | | | | | |
|---|---|---|---|---|---|
| 3,732,816 | A | * | 5/1973 | Muller | 102/306 |
| 4,041,866 | A | | 8/1977 | Thevenin et al. | 102/24 HC |
| 4,341,983 | A | | 7/1982 | Gottliebson | 318/102 |
| 4,474,113 | A | * | 10/1984 | Kyro et al. | 102/476 X |
| 4,491,500 | A | | 1/1985 | Michaud et al. | 156/628 |
| 4,494,459 | A | * | 1/1985 | Ziemba et al. | 102/476 X |
| 4,498,367 | A | | 2/1985 | Skolnick et al. | 86/1 R |
| 4,499,830 | A | | 2/1985 | Majerus et al. | 102/476 |
| 4,537,132 | A | * | 8/1985 | Sabranski et al. | 102/307 |
| 4,590,861 | A | * | 5/1986 | Bugiel | 102/307 X |
| 4,669,384 | A | | 6/1987 | Chawla et al. | 102/307 |
| 4,672,896 | A | * | 6/1987 | Precoul et al. | 102/476 X |
| 4,702,171 | A | | 10/1987 | Tal et al. | 102/476 |
| 4,739,707 | A | * | 4/1988 | Regalbuto et al. | 102/307 |
| 4,766,813 | A | | 8/1988 | Winter et al. | 102/307 |
| 4,818,333 | A | | 4/1989 | Michaud | 156/628 |
| 4,841,864 | A | * | 6/1989 | Grace | 102/476 X |
| 4,958,569 | A | | 9/1990 | Mandigo | 102/476 |
| 4,979,443 | A | * | 12/1990 | Rittel et al. | 102/307 |
| 5,033,387 | A | * | 7/1991 | Lips | 102/306 X |
| 5,090,324 | A | | 2/1992 | Böcker et al. | 102/307 |
| 5,155,297 | A | * | 10/1992 | Lindstadt et al. | 102/306 X |
| 5,259,317 | A | | 11/1993 | Lips | 102/307 |
| 5,349,908 | A | * | 9/1994 | Walz et al. | 102/307 |
| 5,619,008 | A | | 4/1997 | Chawla et al. | 102/310 |
| 6,021,714 | A | | 2/2000 | Grove et al. | 102/307 |
| 6,167,811 | B1 | * | 1/2001 | Walters | 102/307 X |

FOREIGN PATENT DOCUMENTS

| | | | | |
|---|---|---|---|---|
| DE | 3531689 | * | 3/1987 | 102/476 |
| EP | 0 105 495 A1 | | 4/1984 | |
| GB | 832685 | | 4/1960 | |
| GB | 854043 | | 11/1960 | |
| GB | 1 504 431 | | 2/1978 | |
| GB | 2 303 687 A | | 2/1997 | |
| GB | 2 326 220 A | | 12/1998 | |

OTHER PUBLICATIONS

Walters et al., "Fundamentals of Shaped Charges," pp. 339–351 (John Wiley & Sons, 1989).
Delacour et al., "A New Approach to Elimination of Slug in Shaped Charge Perforating," Paper No. 941–G, pp. 1–10 (1957).

* cited by examiner

*Primary Examiner*—Peter A. Nelson
(74) *Attorney, Agent, or Firm*—Trop, Pruner & Hu PC

(57) ABSTRACT

The perforating device for use in completing a well includes a case, an explosive charge contained in the case, and a generally bowl-shaped liner. The liner is positioned adjacent the explosive charge and has non-uniforrn thickness along its length. The liner further includes a protruding portion near its tip. In another configuration, the liner includes a hole near its tip to expose a portion of the explosive charge.

40 Claims, 11 Drawing Sheets

PERFORATING DEVICES FOR USE IN WELLS

CROSS-REFERENCE TO RELATED APPLICATION

The present application claims priority under 35 U.S.C. §119(e) to U.S. Provisional Patent Application Serial No. 60/100,233, entitled "Perforating Devices Used in Wells," filed Sep. 14, 1998.

STATEMENT REGARDING FEDERALLY SPONSORED RESEARCH

The United States Government has rights in this invention pursuant to Contract No. W-7405-ENG-48 between the U.S. Department of Energy and the University of California, for the operation of Los Alamos National Laboratory, and pursuant to CRADA No. LA93C10074, "Advanced Down-Hole Perforating Technologies," between Schlumberger Perforating and Testing Center and Los Alamos National Laboratory.

BACKGROUND

The invention relates to perforating devices for use in wells.

Perforating devices have been used by the oil-well service industry for many years to complete oil and natural gas wells. When wells are drilled into deep rock formations, they are cased to prevent the surrounding rock, sand, and water from invading the wellbore and interfering with the production of oil or natural gas. A typical casing material is high-strength steel pipe. In completing a well, a perforating device having an array of perforators (which may be shaped charge perforators) is lowered downhole into the well in a perforating gun. When the gun is at the correct depth in the well the perforators are fired, sending shaped charge jets outward first through the side of the gun, then through the fluid between the gun and the casing, through the well casing, and finally into the oil-bearing or natural gas-bearing rock. The resulting holes in the well casing allow the oil or natural gas to flow into the well and to the surface. What remains of the gun may be withdrawn from the well after the perforators have been fired.

The downhole formation adjacent the well may have many different characteristics. As examples, the formation may include competent rock that contains oil, gas or a loosely consolidated sand containing hydrocarbons. These types of formations govern the kind of perforators that are needed to complete the well. In the first case a perforator is needed that produces a large depth of penetration so that the maximum amount of rock is exposed to the hole in the well casing. In the latter case a perforator is needed that makes as large a hole in the well casing as possible so that gravel can be pumped through the hole to form a gravel pack, and depth of penetration is a secondary consideration. Penetrators used to create such large holes are sometimes referred to as big hole penetrators.

A shaped charge perforator may include a liner, a case to contain the liner, a high explosive, and some mechanism to initiate the detonation of the explosive. Typical materials for the case include steel or zinc. Typical liner materials include wrought materials such as copper, zinc, and various alloys or pressed powder including a mixture of copper, lead, and tungsten. An often used initiation mechanism includes a detonating cord that is positioned onto an opening at the rear of the perforator. Since the gun is typically withdrawn from the well after the perforators are fired, there is a constraint on the amount of explosive in the perforators. Furthermore, since perforators are used in large numbers every year, cost is a very important factor—both materials cost and manufacturing cost.

One way of manufacturing liners includes deep drawing a metal sheet into various shapes, such as conical, hemispherical shapes, and parabolic. Because ease of manufacture is an important consideration, these deep-drawn liners have approximately uniform thickness that approximates the uniform thickness of the original metal sheet. In order to be deep drawn, the liner material must be very ductile, so copper is often the material of choice. Other reasons for favoring copper are that copper has good penetration properties and copper is comparatively inexpensive.

SUMMARY

In general, according to an embodiment, a perforating device for use in completing a well includes a case, an explosive charge contained in the case, and a generally bowl-shaped liner positioned adjacent the explosive charge and having non-uniform thickness along its length. The liner includes a protruding portion near its apex.

Other features of the invention will become apparent from the following description and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

A perforating device according to some embodiments of the invention includes a shaped charge perforator adapted to form a perforating jet that makes a relatively large hole in the surrounding well casing during well completion.

Figure 1:
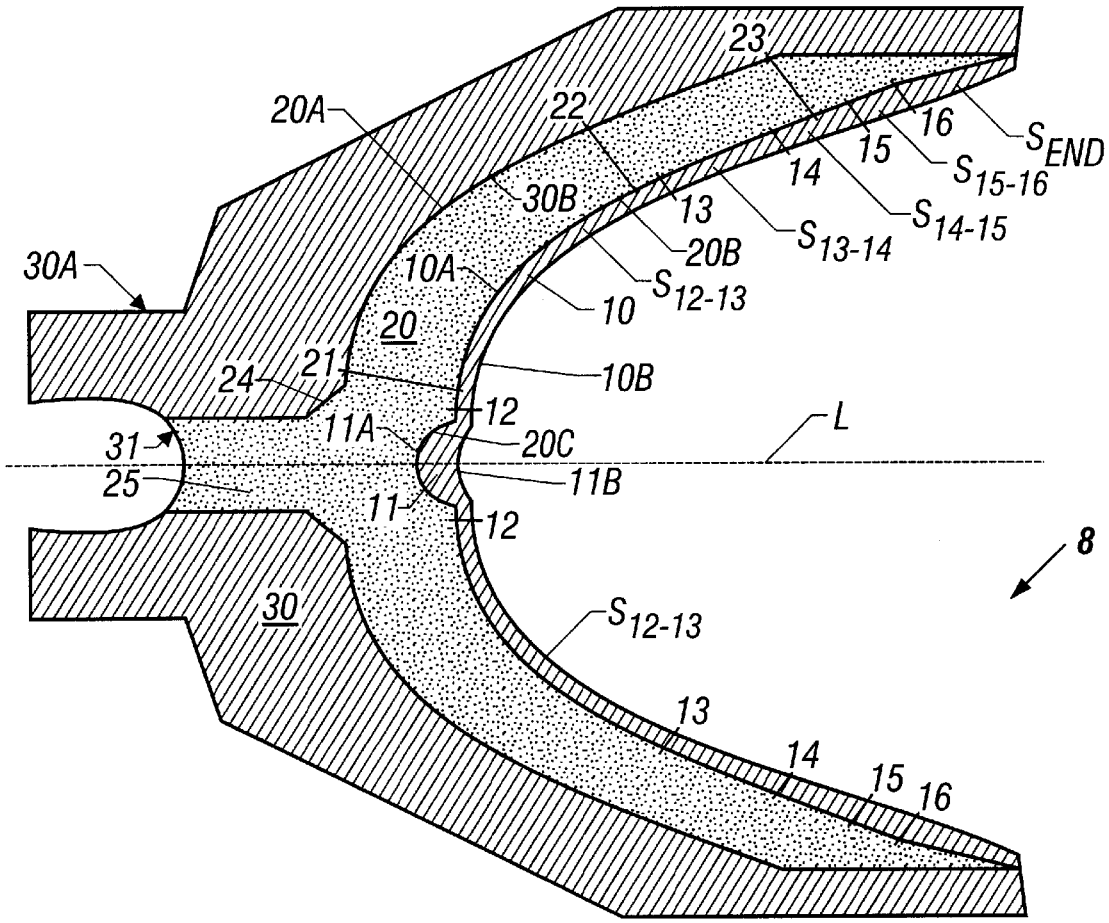
FIG. 1 is a diagram of a shaped charge perforator according to an embodiment of the invention that has a liner with a nipple-shaped protrusion.

Referring to FIG. 1, a perforating device according to an embodiment of the invention includes a shaped charge perforator 8 having a liner 10 and an explosive charge 20, both contained in a case 30 (which can be made of steel, for example). A dotted line L through the center of the shaped charge perforator 8 generally represents the axis of symmetry of the liner 10 and explosive 20. A detonating cord (not shown) may be positioned in an opening 31 located generally at the rear of the case 30. The outer surface 30A of the case 30 may be formed to fit into a holding apparatus inside a perforating gun (such as the gun shown in FIG. 7).

The liner 10 may include a powder that is a mixture of copper and lead or some other high-density material, including tin, zinc, aluminum, tungsten, nickel, silver, gold, tantalum, or a metal alloy. Further, solid liners may be used. Using the standard techniques of pressing metal powders, virtually any shape liner can be made. Typically, the assembly of perforators is done by pressing the drawn liner 10 into a pre-made case 30, into which the correct amount of explosive charge 20 has been poured. The explosive charge 20 may optionally be pressed into a shape to accept the liner 10 prior to the liner being pressed into the final assembly. The liner 10 may be made slightly oversized to ensure a tight fit within the case 30. This tight fit of the liner 10 and explosive charge 20 in the case 30 helps keep the entire perforator device intact during shipment, assembly into the gun, and lowering of the gun down the well into a firing position.

The case 30 may be generally axially symmetric (with respect to the axis L) except at the surface 31, which represents a slot in the rear end of the case where the detonating cord (not shown) is in contact with the explosive charge 20. The inner surface 30B of the case 30 defines the shape of the main explosive 20 and the liner 10. Upon initiation of the perforating device 8, the case 30 acts to confine the main explosive 20.

The liner 10 of the perforating device 8 has a generally bowl-like or semi-hemispherical shape. The generally bowl-like shape of the liner 10 aids in producing a perforating jet pattern upon firing that creates an entrance hole in the surrounding well casing having a relatively large diameter (a "big hole"). Other liner shapes can also create big holes, including liners that are generally conical-shaped, parabolic-shaped or tulip- or trumpet-shaped. According to an embodiment, the thickness of the liner 10 may vary according to its distance from the center axis L.

The liner 10 also includes a protruding portion 11 that is formed generally near the apex or tip (represented generally as 25) of the bowl-shaped liner 10. The protruding portion 11 according to the illustrated embodiment is generally nipple-shaped, having a slight groove 11B on the inner surface 10B of the liner 10 (the concave surface facing away from the gun). On the outer surface 10A of the liner 10 (the convex surface facing the main explosive charge 20), a generally rounded bump or hill-shaped portion 11A is formed that is integral with the liner 10. Thus, as illustrated, the protruding portion 11 juts out into the explosive charge 20 from the rest of the liner 10.

The liner 10 in the illustrated embodiment is separated into several sections (represented by $S_{i-j}$), each generally symmetrical about its center axis L. However, it is contemplated that the liner 10 need not be generally symmetrical about its center axis L in other embodiments. In the embodiment of FIG. 1, the multiple segments S of the liner 10 may each have different curvatures. For example, a section $S_{12-13}$ may be generally parabolic or hyperbolic in shape, whereas the next section $S_{13-14}$ may be generally conical in shape. The section $S_{12-13}$ (defined between edges 12 and 13) is adjacent and integrally connected to the nipple-shaped portion 11. In the illustrated embodiment, the section $S_{12-13}$ may be connected to the nipple-shaped portion 11 at an angle that is nearly perpendicular to the axis L. In section $S_{12-13}$, the radius of curvature of the liner 10 may increase with increasing distance from its center axis L. Further, in the section $S_{12-13}$, the thickness of the liner 10 may gradually increase with distance away from the apex of the liner 10. At edge 13, the generally parabolic section $S_{12-13}$ of the liner 10 joins a generally conical section $S_{13-14}$ that gradually increases in thickness from edge 13 to edge 14. At edge 14, the section $S_{13-14}$ is connected to another generally conical section $S_{14-15}$. Further, at edge 14, a step increase in thickness occurs from section $S_{13-14}$ to section $S_{14-15}$. In the section $S_{14-15}$, the liner 10 also gradually varies in thickness between edges 14 and 15. At edge 15, another step increase in thickness is formed between the sections $S_{14-15}$ and $S_{15-16}$. In the section $S_{15-16}$, the liner 10 may continue to increase in thickness until it reaches edge 16, where the liner 10 begins to decrease in thickness in the last section $S_{END}$. Thus, the generally bowl-shaped liner 10 has a thickness that increases from near its tip to the edge 16 with several step increases formed in the liner 10 at predetermined locations. The step increases may be formed on the outer surface 10A (the convex surface) of the liner 10.

Although, the embodiment of FIG. 1 includes a liner having a thickness that increases with distance from a center axis, other embodiments may include a liner in which the thickness may have other variations.

Due to the protruding portion 11 and the varying liner thickness, the liner 10 of the illustrated embodiment increases the formation of a thick jet such that an entrance hole with increased diameter may be created in the surrounding well casing. The nipple-shaped portion 11 enables the collapsing liner 10 to encapsulate some of the explosive gases during the jet formation process while the increasing thickness of the parabolic or hemispherical section of the liner 10 causes the formation of a relatively thick jet. The encapsulated gas increases the diameter of the jet over what it would otherwise be if the gas were not encapsulated.

Because the liner has increasing radius of curvature with increasing distance from the center axis L, a narrow, pointed jet tip can be formed, which creates a relatively small opening in the gun tube. Thus, during the initial collapse of the liner, a sharp tip is formed in the perforating jet to make a small hole in the gun tube. Having small holes in the gun tube prevents debris from falling into and contaminating the wellbore. However, to create large holes in the casing, a perforating jet with a large bulge is needed. To accomplish this, the variable thickness liner is used in which the thickness increases with increasing distance from the apex of the liner. By having step increases in thickness at predetermined locations in the liner, an extended bulge in the perforating jet can be created. Further, by encapsulating a bubble of explosive gases, the diameter of the resulting perforating jet is also increased. Thus, embodiments of the invention may have the advantage of being able to create large holes in the surrounding casing while creating small holes in the gun tube.

In the illustrated embodiment, the explosive charge 20 may also generally be bowl-shaped, and its thickness may be selected to be thicker near the tip (indicated generally as 21) and decreases in thickness gradually to 22, and further gradually decreases thickness to 23. The inner surface 20B of the explosive charge 20 has an indented portion 20C that mates with the surface 11A of the nipple-shaped portion 11 of the liner 10.

At its outer surface 20A (the convex surface contacting the inner surface 30B of the case 30), the explosive charge 20 may have a slanted segment 24 formed between a segment 25 that is coupled to the primer cord (not shown) and the main body of the explosive charge 20. When the explosive charge 20 is initiated, a detonation wave starts in the segment 25 and sweeps in a forward direction. The slanted segment 24 assists the detonation wave in turning the corner from the segment 25 to the main body of the explosive charge 20. The configuration of the slanted segment 24 may vary with the type of explosive charge used, since the ability of the detonation wave of different types of charges to turn corners may be different. The segment may be made smaller in those explosives that are more sensitive, such as HMX ($C_4H_8N_8O_8$), and larger in those explosives that are less sensitive, such as TATB ($C_6H_6N_6O_6$).

Figure 2A:
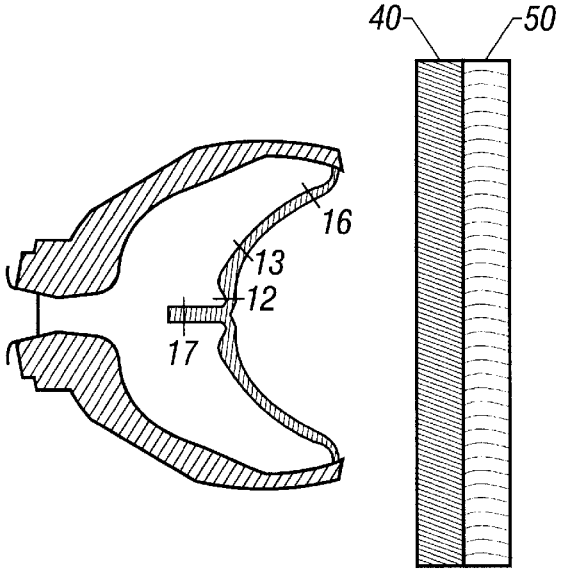
FIGS. 2A–2F illustrate the jet formation and penetration of the gun and well fluid upon activation of the shaped charge perforator of FIG. 1.
Figure 2B:
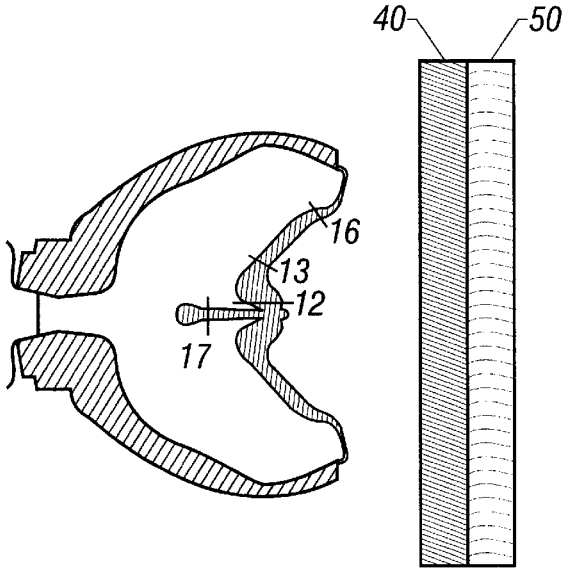
Figure 2C:
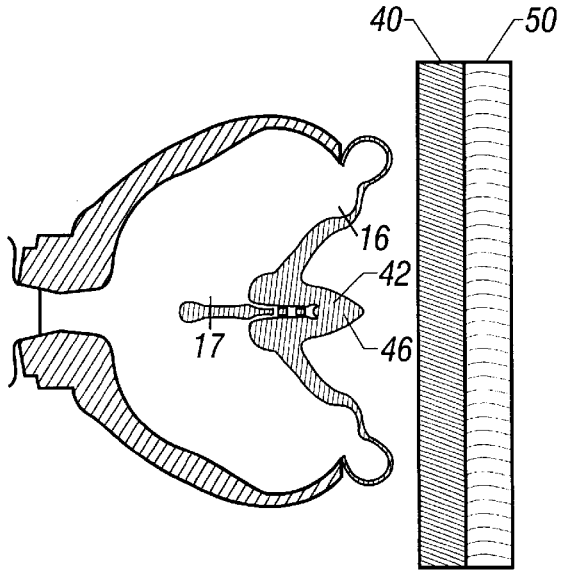

The formation and penetration of the perforating jet from the liner 10 of FIG. 1 is illustrated in FIGS. 2A–2F, which represent snap-shots of the shaped charge formation and penetration at different times. In all of these figures, a section 40 represents the wall of the perforating gun that holds the multiple perforators during well completion, and well fluid outside the perforating gun wall 40 is generally represented as 50. The well casing (not shown) is to the right of the well fluid 50. When the explosive charge 20 is detonated, the detonation pressure creates a wave that collapses the liner 10. Material from the collapsed liner 10 flows along stream lines to form a perforating jet (such as the jet 42). In FIG. 2A, shortly after detonation of the explosive, the nipple-shaped portion 11 has collapsed to form a short slug 17. As seen in FIGS. 2B–2F, the slug 17 moves very slowly compared to the rest of the collapsing liner 10. In FIG. 2B, the liner 10 begins to collapse, starting with section $S_{12\text{-}13}$. In FIG. 2C, the collapsing liner 10 forms a perforating jet 42. Also, a portion of the slug 17 begins to break apart into particles. The liner 10 continues to collapse in FIGS. 2D–2F, with the liner collapsing into the jet 42 in generally the following order: beginning with the protruding portion 11 and followed by the sections $S_{12\text{-}13}$, $S_{13\text{-}14}$, $S_{14\text{-}15}$, $S_{15\text{-}16}$, and the end portion $S_{END}$.

Figure 2D:
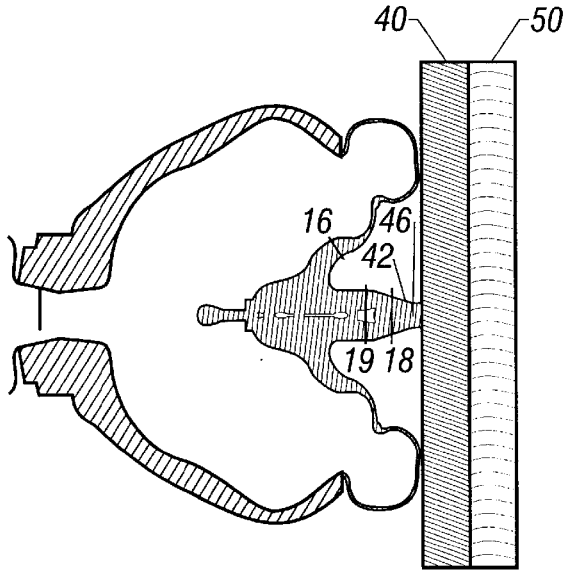
Figure 2E:
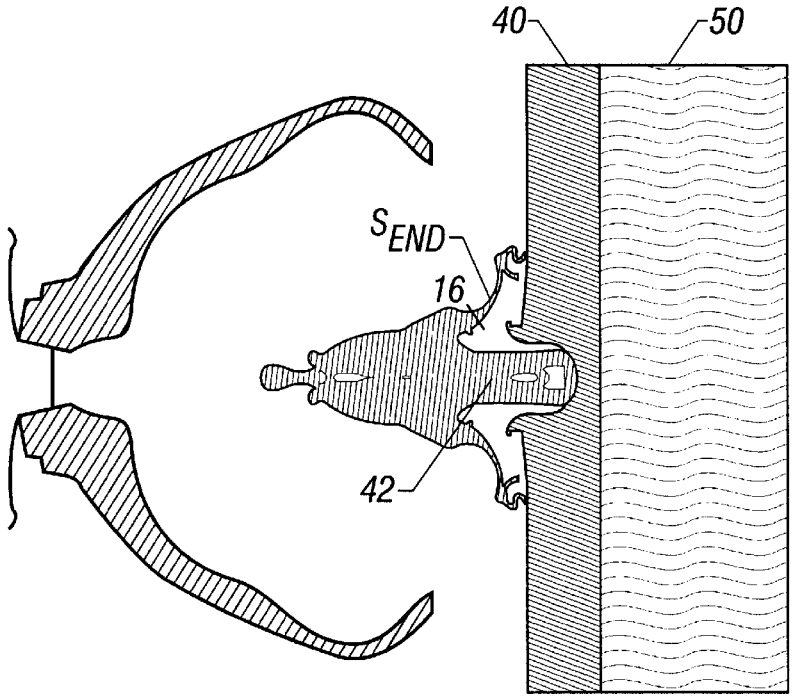
Figure 2F:
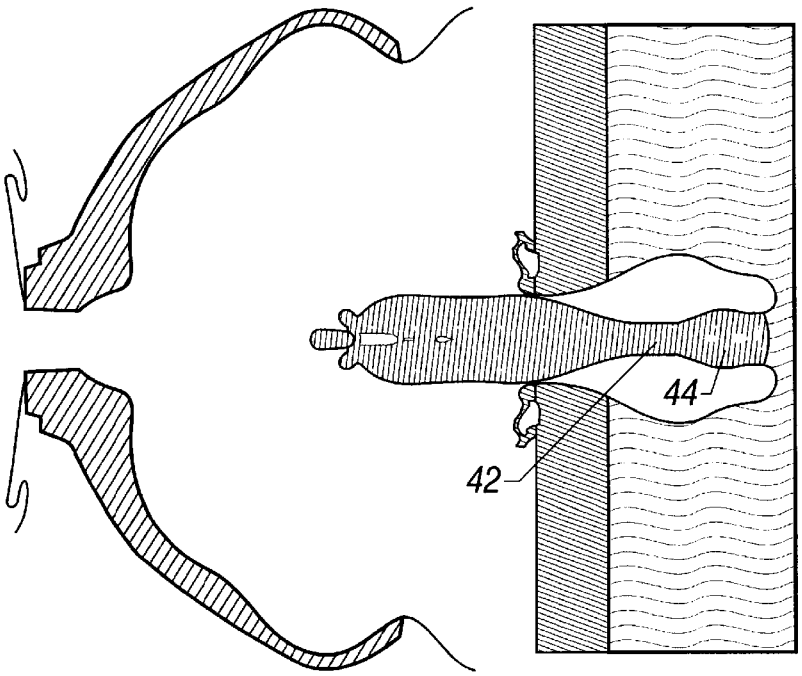

As shown in FIG. 2D, the explosive gases are encapsulated within the perforating jet 42 generally at 19 during the perforating jet formation process. In FIG. 2E, most of the liner 10 has collapsed (with the section $S_{END}$ remaining) and the perforating jet 42 has penetrated most of the way through the perforating gun wall 40. In FIG. 2D, the tip 46 of the perforating jet 42 is relatively sharp to create a smaller opening in the gun wall 40. In FIG. 2F, section $S_{END}$ has collapsed into the perforating jet 42, which in FIG. 2F has perforated all the way through the wall 40 and into the well fluid 50.

The function of the last section of the liner (section $S_{END}$) is illustrated in FIGS. 2E and 2F. Being generally thinner than its neighboring section $S_{15\text{-}16}$, the section $S_{END}$ of the liner leads its neighboring portions slightly; that is, its collapse speed is slightly higher than its neighboring portions. As a result, the section $S_{END}$ of the liner adds material to the trailing portion of a bulged portion 44 shown in FIG. 2F.

On the other hand, if the thickness of the liner 10 were constant, collapse of the liner from edge 12 in FIG. 1 to edge 16 would produce a thin jet forward of point 19 in FIG. 2D. This thin jet would produce a small-diameter hole in well casings (not shown). However, if there was a single step increase in thickness in the liner, for example at edge 14, then there would be a bulge in the resulting jet at some position before point 19 in FIG. 2D. In like manner, a series of step increases in thickness along the liner 10 will produce a corresponding series of bulged portions. By spacing these steps according to predetermined distances and varying the magnitudes of the thicknesses, the bulged portions may be made to merge with one another producing a thick, extended and generally cylindrical segment traveling rapidly through the well fluid as shown (44) in FIG. 2F. This thick jet produces the increased diameter holes in the well casing which give this perforator design its superior performance.

The perforating gun is generally not centralized inside the casing, causing the individual jets to penetrate varying amounts of wellbore fluid before penetrating the casing. The portion of the jet that eventually penetrates and produces a hole in the casing (which may be made of steel, for example) therefore varies according to the amount of fluid it encounters. This causes typically larger hole diameters for gun clearances that are 0–1 times the diameter of the shaped charge and smaller holes for clearances that are typically greater than the diameter of the shaped charge. The maximum hole diameter in the casing is produced by timing the location of the maximum bulge in the jet (enhanced by the encapsulated explosive gases) so that it just starts penetrating the casing.

Figure 3:
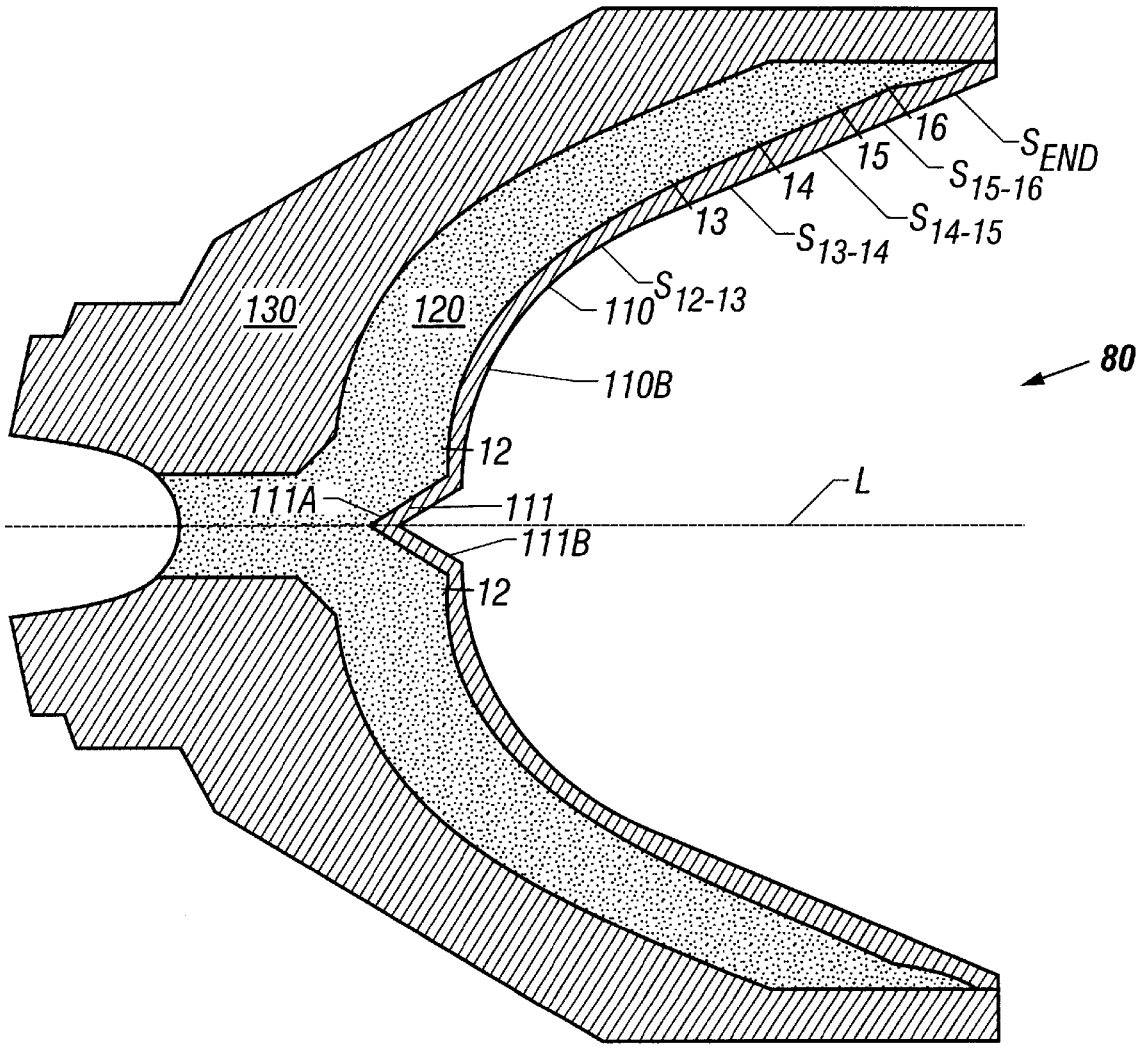
FIG. 3 is a diagram of a shaped charge perforator according to another embodiment of the invention that has a liner with a conical-shaped protrusion.

Referring to FIG. 3, a perforator 80 according to another embodiment has a liner 110 with a protruding portion 111 that is generally conical-shaped. Thus, instead of the nipple-shaped portion 11 having a rounded bump 11A that is used in the liner 10 of the embodiment of FIG. 1, the liner 110 of the FIG. 3 embodiment uses a more pronounced protrusion in the general form of a cone 111A. A corresponding deep groove 111B may also formed on the concave surface 110B of the liner 110.

The liner 110 of FIG. 3 also may have the varying thickness feature of the liner 10 of FIG. 1. As with the liner 10, the liner 110 in the FIG. 3 embodiment also may have step increases occurring at edges 14 and 15 (or at other predetermined locations). The rest of the perforator 80, including the case 130 and the explosive charge 120, are substantially similar in structure except for where the explosive charge 120 mates with the protruding portion 111 of the liner 110 in FIG. 3 and a slight difference in the shape of the outer surface of the case 130. The collapse of the conical-shaped portion 111 into a slow-moving slug of the perforating jet is essentially the same as in FIGS. 2A–2D.

Figure 4:
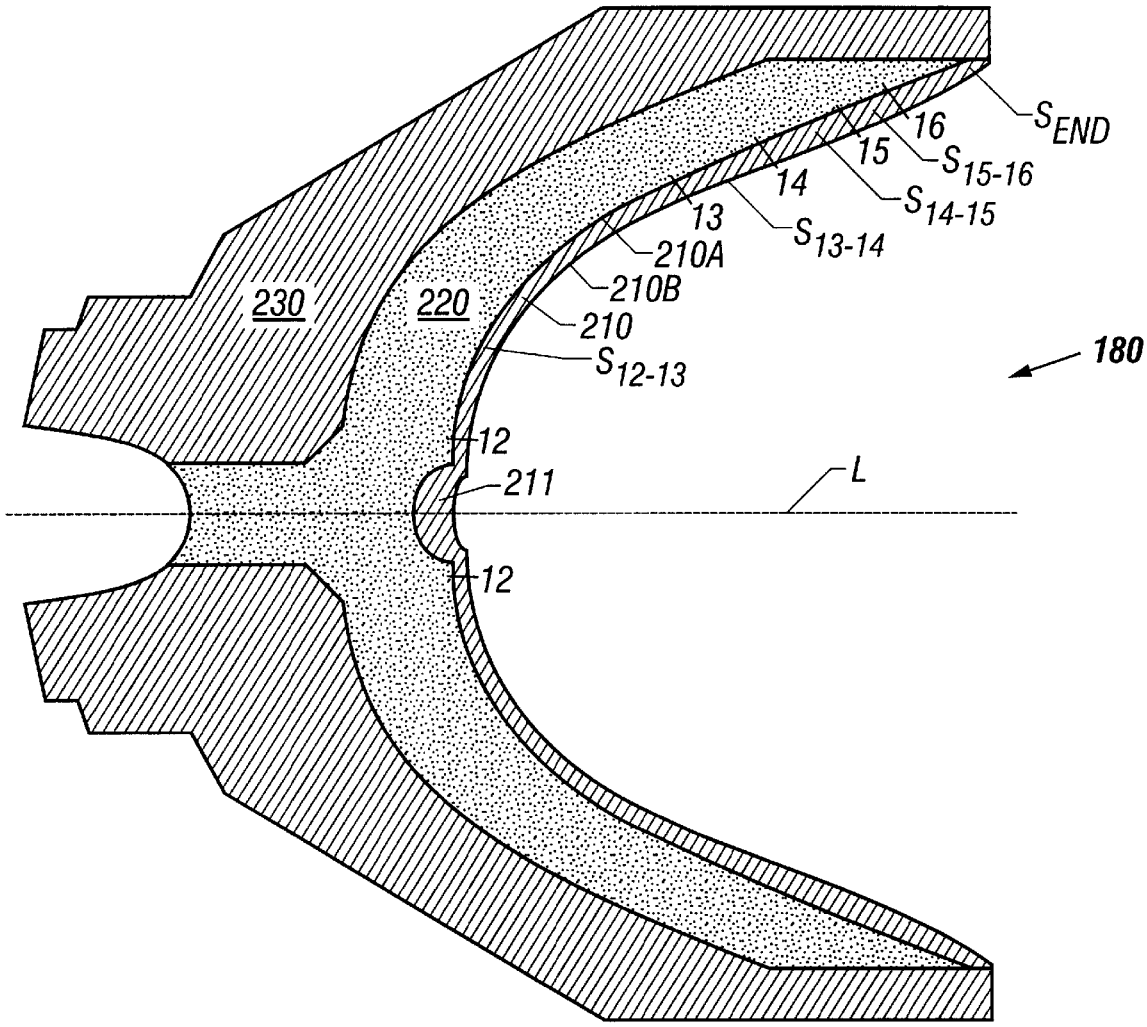
FIG. 4 is a diagram of a shaped charge perforator according to yet another embodiment that has a liner with a nipple-shaped protrusion.

Referring to FIG. 4, a perforator 180 according to yet another embodiment includes a shaped charge liner 210 in which the step increases in thickness are on the inner surface 210B of the liner 210 (the concave surface), in contrast to the steps formed in the outer surface 10A in the liner 10 of FIG. 1. The protruding portion 211 of the FIG. 4 embodiment is substantially the same as the protruding portion 11 of the FIG. 1 embodiment. Within each section $S_{12\text{-}13}$, $S_{13\text{-}14}$, $S_{14\text{-}15}$, and $S_{15\text{-}16}$, the thickness of the liner 210 also gradually increases with distance from the liner's apex, much like the thickness 10 variation in the FIG. 1 liner 10. The function of the section $S_{END}$, which decreases in thickness, is described above. The collapse and jet formation of this third embodiment is essentially the same as that described in FIGS. 2A–2F.

Figure 5:
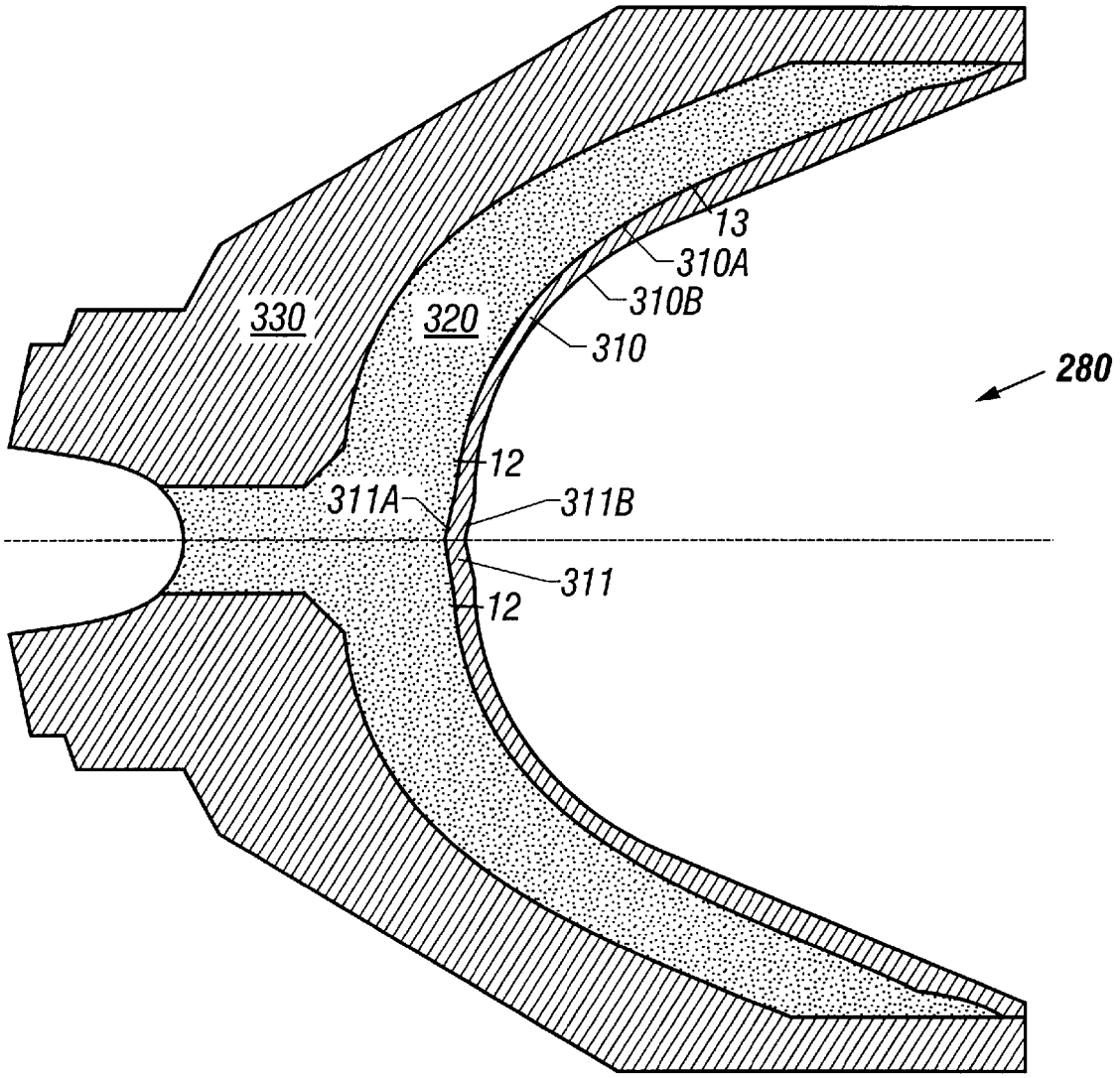
FIG. 5 is a diagram of a shaped charge perforator according to a further embodiment that has a liner with a shallow protrusion.
Figure 6A:
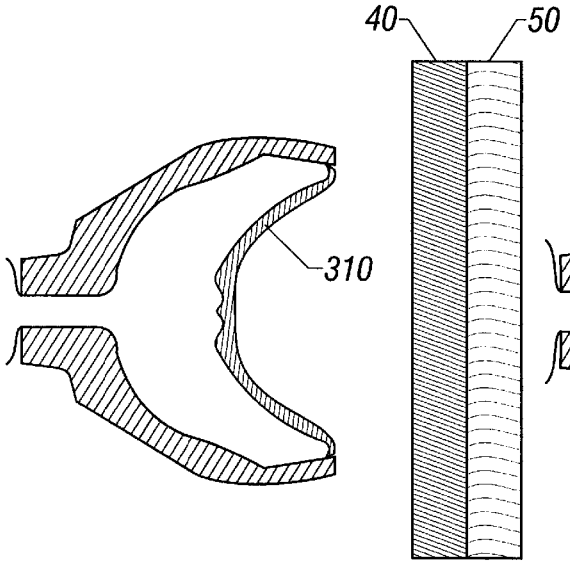
FIGS. 6A–6D illustrate the jet formation and penetration of the gun and well fluid when the shaped charge perforator of FIG. 5 is activated.
Figure 6B:
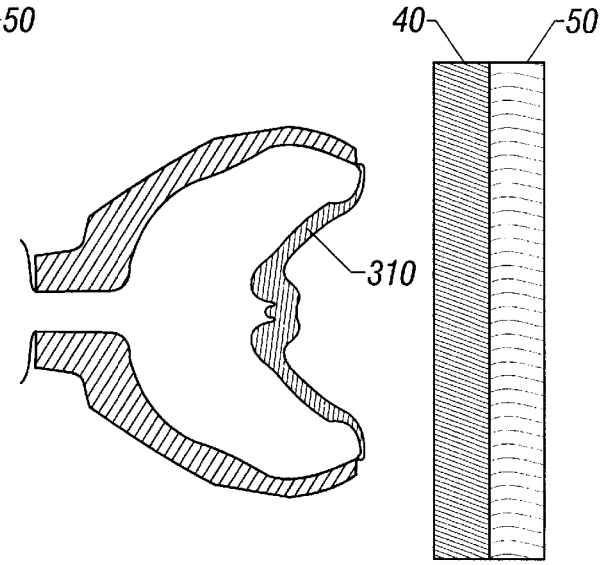
Figure 6C:
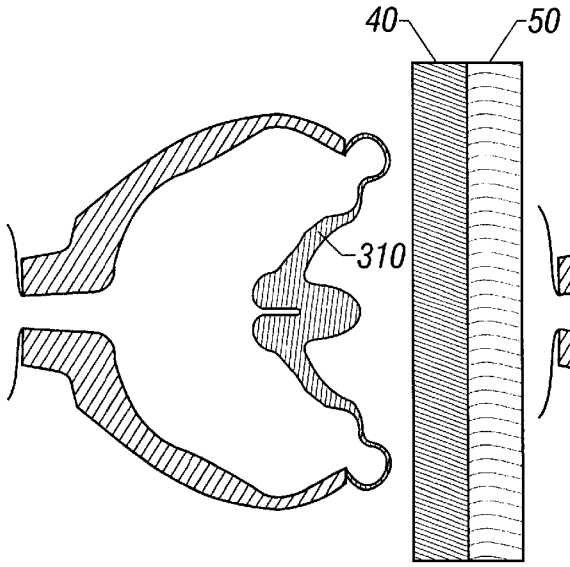
Figure 6D:
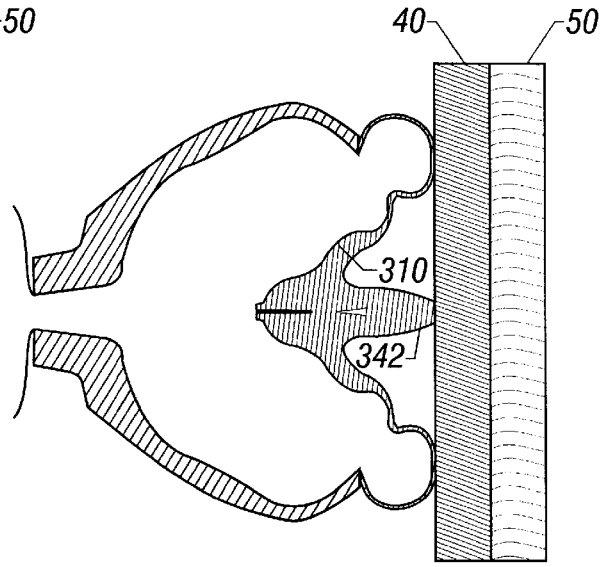

Referring to FIG. 5, a perforator 280 according to a further embodiment includes a shaped charge liner 310 in which the nipple-shaped protruding portion 11 of the FIG. 1 liner 10 has been replaced with a protruding portion 311 having a general shape of a very shallow cone. Thus, to create the slight protruding portion 311, a slight bump 311A is formed on the outer surface 310A of the liner 310 and a corresponding slight groove 311B is formed on the inner surface 310B of the liner 310. The liner 310 also is configured to have varying thicknesses along its length. Again, the other components in the perforator 280, such as the explosive charge 320 and the case 330, may be substantially the same as the corresponding components in the perforator 8 of the FIG. 1 embodiment. The formation of the jet from the liner in FIG. 5 is shown in FIGS. 6A–6D, which are snapshots of the liner collapse process at about the same times as FIGS. 2A–2D, respectively. As illustrated, because of the slight protruding portion 311 used, a slug is not created during the collapse of the liner 310 in the FIG. 5 embodiment. Thus, formation of a slow-moving slug is not essential to the process of encapsulating explosive gases into the perforating jet 342.

Figure 7A:
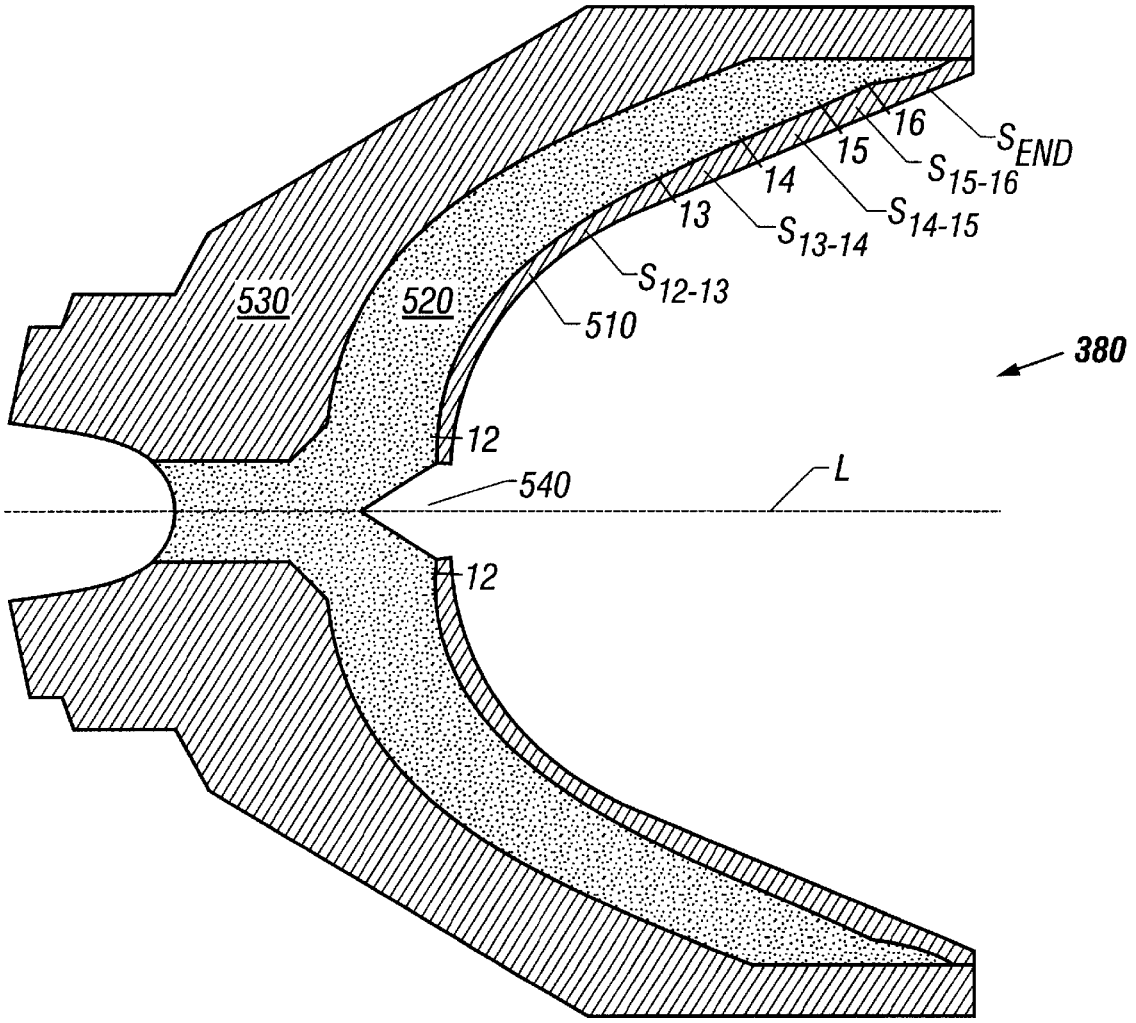
FIGS. 7A–7C are diagrams of shaped charge perforators according to yet further embodiments of the invention.
Figure 7B:
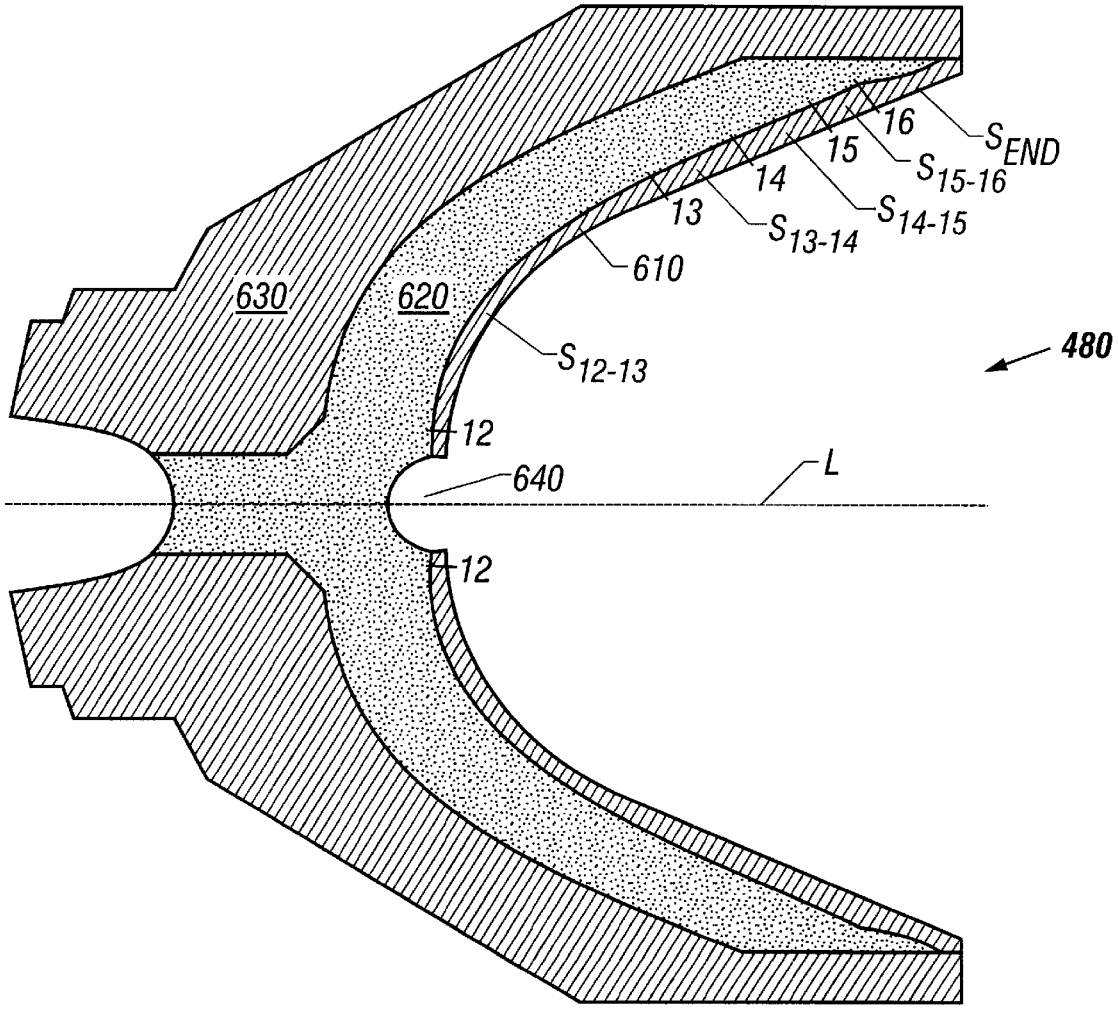
Figure 7C:
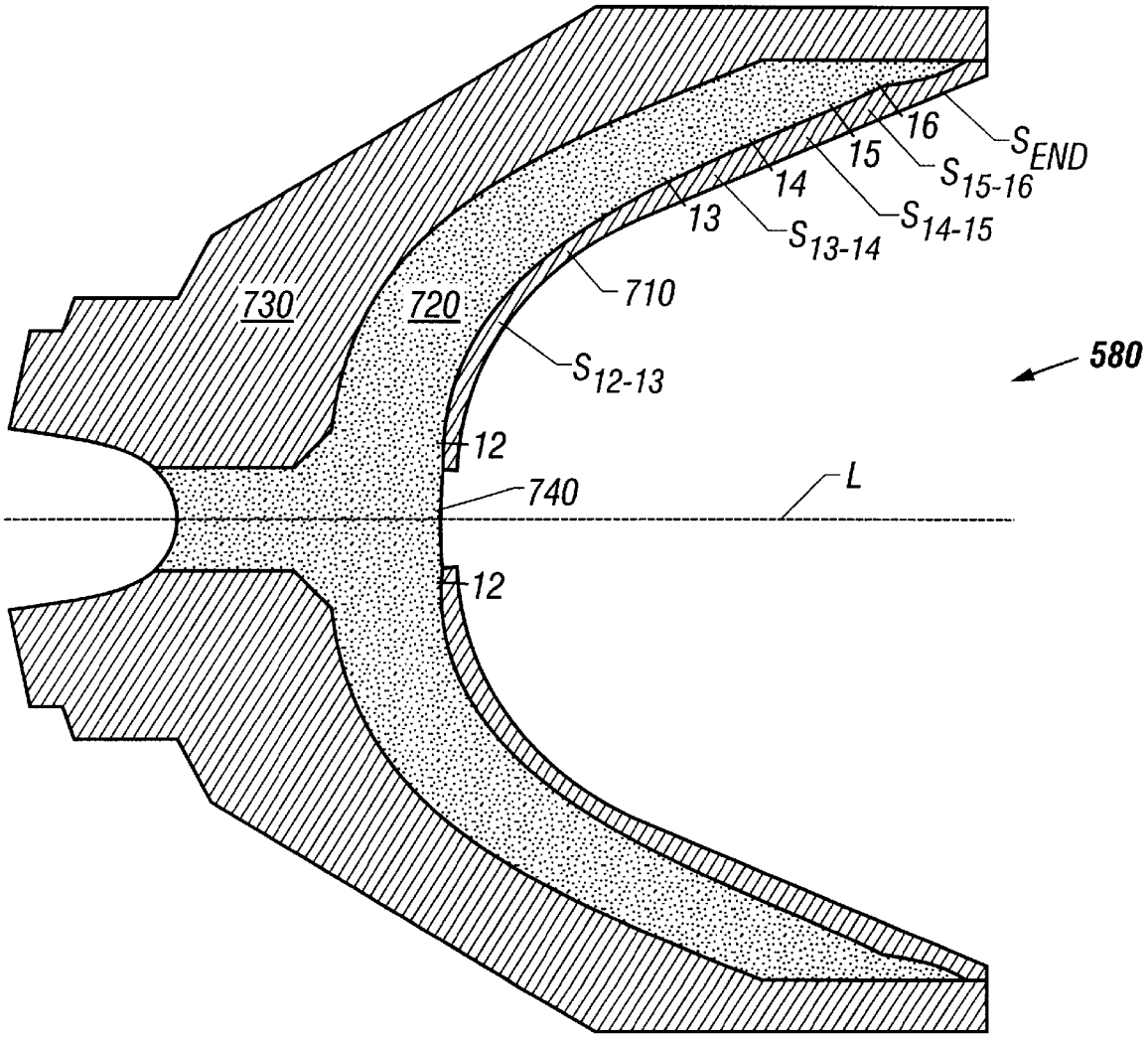

Referring to FIGS. 7A, 7B, and 7C, perforators according to further embodiments include shaped charge liners each with a hole generally in the apex of the liner. FIG. 7A shows a shaped charge 380 having a liner 510, an explosive 520, and a case 530, and FIG. 7B shows a shaped charge 480 having a liner 610, explosive 620, and case 630. In each of the shaped charges 380 and 480 an unlined shaped cavity region 540 (FIG. 7A) and 640 (FIG. 7B) in the explosive (520 and 620) is located near the apex of the liner (510 and 610). The effect is similar to the shaped charges of FIGS. 1–5, in that gases are encapsulated in the jet, forming a bulge that produces larger holes in the casing. The advantage of these embodiments is that it is easier to manufacture. FIG. 7A shows an embodiment with a conical shaped cavity 540, FIG. 7B shows an embodiment with a generally bowl-shaped cavity 640, and FIG. 7C shows a shaped charge 580 with a liner 710, explosive 720, and a case 730 having generally the same geometry (liner with a hole in the apex) but without the shaped explosive cavity. Table 1 shows experimental results of the effect of having unlined shaped explosive cavity near the apex of a liner with a hole in it. The experimental results summarized in Table 1 are for the shaped charges 480 and 580 of FIGS. 7B and 7C according to experimental embodiments.

TABLE 1

| Water clearance | Casing diameter produced by shaped charge 480 | Casing diameter produced by shaped charge 580 |
|---|---|---|
| .95" | 1.24" | 1.17" |
| 1.65" | 1.11" | 1.11" |

Each data entry represents the average of more than 30 shots created by shaped charges according to the experimental embodiments. There is an apparent beneficial increase in hole size of about 6% at the 0.95" water clearance. (The effect was seen to be slightly more than 6% increase when the small explosive cavity was lined with a thin copper liner.) Note that the effect is localized—the encapsulation of the explosive gas increases the casing hole diameter only with water clearances of about 1 inch or less. For clearances larger than that, the bulge is expended by penetrating the water and is gone by the time the jet penetrates the casing. That is why the hole diameters produced by shaped charges according to experimental embodiments are about the same at 1.65" of water clearance.

Figure 8:
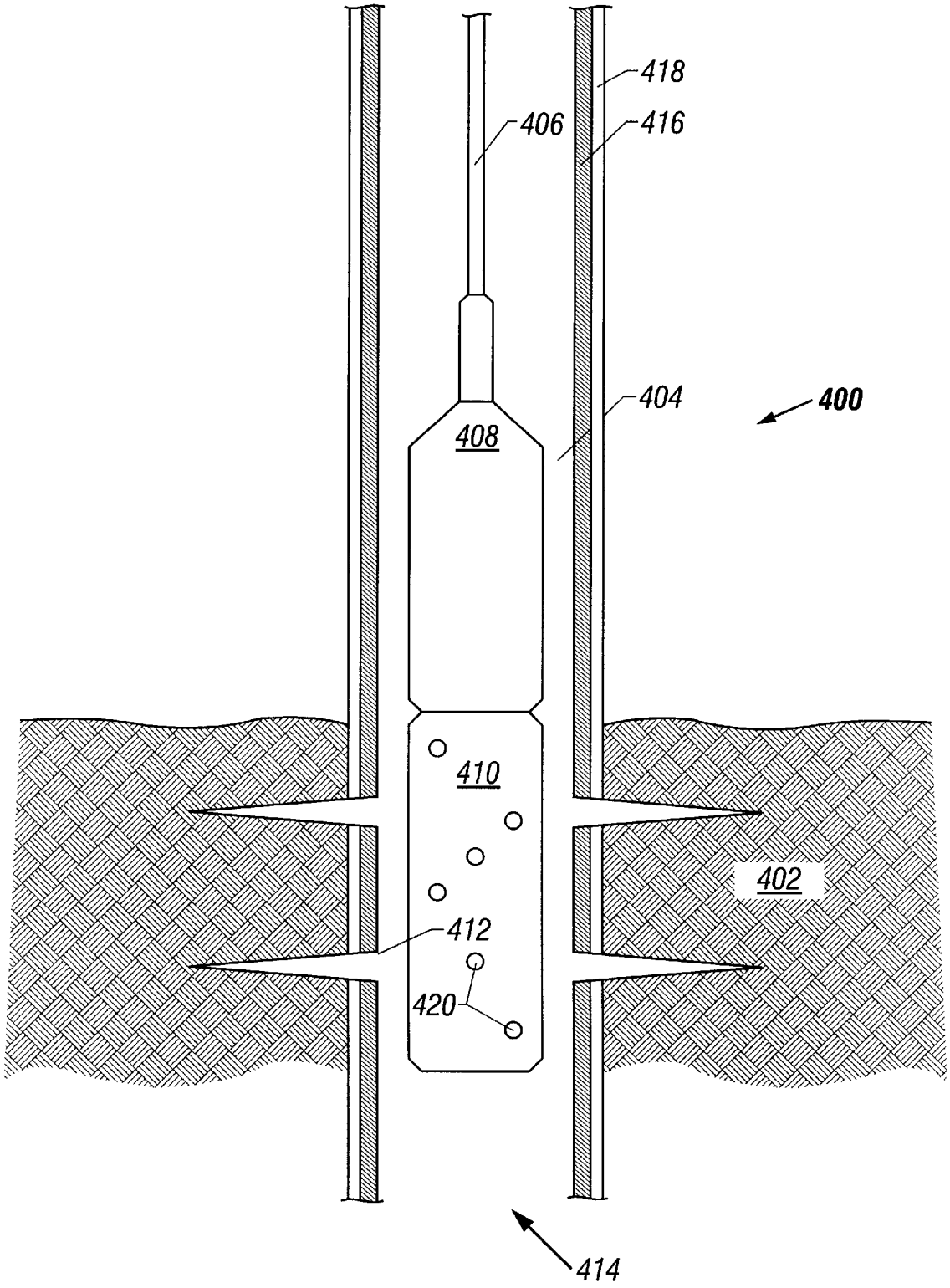
FIG. 8 is a diagram of a perforating string incorporating an embodiment of the invention.

Referring to FIG. 8, an exemplary perforating string 404 that can incorporate embodiments of the invention is positioned in a wellbore 414. The perforating string 404 is lowered down in the wellbore 414 adjacent a pay zone 402 that contains oil or gas in a formation 400. The wellbore 414 is cased by casing 416 that is held in place by a cement layer 418. The perforating string 404 is carried by a tubing 406 (which can be, for example, a coiled tubing). Alternatively, the perforating string 404 can be carried by a wireline. The tubing 406 is connected to a firing head 408, which is in turn connected to a perforating gun 410. The perforating gun 410 contains shaped charges 420, which are detonated by a detonating cord connected to the firing head 408 and the shaped charges 420. The shaped charges 420 are designed to create perforations in the adjacent casing 416, cement layer 418, and pay zone 402 having relatively large hole diameters. The types of shaped charge perforators that can create such big-hole perforations include the shaped charges described in FIGS. 1–7 above. In the embodiments described, perforators of different sizes may be used, such as 35-mm, 43-mm, or 64-mm perforators.

Perforations having a hole of a relatively large diameter are particularly advantageous for use in controlling sand flow into the wellbore 414 from the surrounding pay zone 402. After perforations 412 are created through the casing 416 and the cement 418 into the adjacent pay zone 402, the perforating string 404 can be removed and equipment to perform gravel packing can be lowered into the wellbore 414 to pack gravel into and around the big-hole perforations 412. The gravel acts as a filter to prevent sand from flowing while still allowing flow of well fluids. Big-hole perforations can also be used in other applications.

While the invention has been disclosed with respect to a limited number of embodiments, those skilled in the art will appreciate numerous modifications and variations therefrom. For example, the particular embodiment chosen to manufacture a particular shaped charge depends upon manufacturing techniques available at any given time. It is intended that the appended claims cover all such modifications and variations as fall within the spirit and scope of the invention.

What is claimed is:

1. A perforating device for use in completing a well, comprising:

a case;

an explosive charge contained in the case; and a generally bowl-shaped liner positioned adjacent the explosive charge, the liner having a first protruding portion near an apex of the liner, the liner further having a second, distinct portion having a thickness varying along a length of the second portion, wherein the liner extends from its apex to an end edge, and wherein the second portion extends from an edge of the first protruding portion to the end edge of the line.

2. The perforating device of claim 1, wherein the first protruding portion is formed as a bump.

3. The perforating device of claim 1, wherein the protruding portion includes a generally nipple-shaped protrusion into the explosive charge.

4. The perforating device of claim 1, wherein the protruding portion includes a generally conical-shaped protrusion into the explosive charge.

5. The perforating device of claim 1, wherein the second portion of the liner has a first section that is generally parabolic and a second section that is generally conical.

6. The perforating device of claim 5, wherein the liner thickness increases gradually in the generally parabolic section and increases in steps in the generally conical section.

7. The perforating device of claim 5, wherein the generally parabolic section has an increasing radius of curvature with increasing distance from its center axis.

8. A perforating device for use in completing a well, comprising:

a case;

an explosive charge contained in the case; and a generally bowl-shaped liner positioned adjacent the explosive charge and having non-uniform thickness along its length, the liner further including a protruding portion near its apex, wherein the liner has a segment separate from the protruding portion that increases in thickness with distance from the liner's apex.

9. The perforating device of claim 1, wherein the second portion of the liner increases in thickness along at least a portion of its length.

10. A perforating device for use in completing a well, comprising:

a case;

an explosive charge contained in the case; and a generally bowl-shaped liner positioned adjacent the explosive charge and having non-uniform thickness along its length, the liner further including a protruding portion near its apex, wherein step increases in thickness are formed at predetermined locations in the liner.

11. The perforating device of claim 10, wherein the step increases in thickness are formed on a convex surface of the liner.

12. The perforating device of claim 10, wherein the step increases in thickness are formed on a concave surface of the liner.

13. The perforating device of claim 1, wherein the second portion of the liner is divided into a segment that increases in thickness with increasing distance from the liner's apex and a segment that decreases in thickness with increasing distance from the liner's apex.

14. A perforating device for use in a well, comprising:

a case;

an explosive charge contained in the case; and a liner positioned adjacent the explosive charge and having a hole near its apex to expose the explosive charge.

15. The perforating device of claim 14, wherein the explosive charge includes a cavity adjacent the liner hole.

16. The perforating device of claim 15, wherein the cavity is generally bowl-shaped.

17. The perforating device of claim 15, wherein the cavity is generally conical-shaped.

18. A method of creating a large diameter perforation using a perforator comprising:

forming a generally bowl-shaped liner having a first protruding portion and a second, distinct portion having variable thickness along a length of the second portion; and firing the detonator to collapse the liner to form a thick perforating jet.

19. The method of claim 18, wherein the second portion of the liner increases in thickness with increasing distance from an apex of the liner.

20. The perforating device of claim 1, wherein the first protruding portion protrudes outwardly from a surface of the liner.

21. The method of claim 18, wherein collapse of the liner forms a perforating jet having a bulged portion that encapsulates gas to increase a size of the bulged portion.

22. A method of creating a large diameter perforation using a perforator comprising:

forming a liner having variable thickness along its length;

firing the detonator to collapse the liner to form a thick perforating jet; and forming a hole in the liner near its apex.

23. The method of claim 22, wherein the liner is contacted to an explosive charge, the method further comprising forming a cavity in the explosive adjacent the liner hole.

24. A well completion apparatus comprising:

a perforating gun; and a shaped charge perforator positioned in the gun, the shaped charge perforator having an explosive charge and a generally bowl-shaped liner that has a protruding portion near an apex of the liner and a second, distinct portion having a thickness that increases with distance from the apex, the liner having an inner surface portion that is generally concave and an outer surface portion that is generally convex.

25. The perforating device of claim 1, wherein at least a part of the second portion of the liner increases in thickness with radial distance from the apex.

26. The apparatus of claim 24, wherein the protruding portion includes a generally nipple-shaped bump.

27. The apparatus of claim 24, wherein the protruding portion includes a generally conical-shaped portion.

28. The apparatus of claim 24, wherein the second portion of the liner has step increases in thickness along its length.

29. The perforating device of claim 8, wherein the protruding portion is formed as a bump.

30. The perforating device of claim 8, wherein the protruding portion bulges from an outer surface of the liner.

31. The perforating device of claim 1, wherein the second portion of the liner has a generally concave inner surface and a generally convex outer surface.

32. The perforating device of claim 1, wherein the first protruding portion bulges from an outer surface of the liner.

33. The perforating device of claim 1, wherein the second portion has plural segments, each of the plural segments having a thickness different than another segment.

34. The perforating device of claim 8, wherein at least a portion of an inner surface of the liner is generally concave and at least a portion of an outer surface of the liner is generally convex.

35. A perforating device for use in completing a well, comprising:

a case;

an explosive charge contained in the case; and a generally bowl-shaped liner positioned adjacent the explosive charge, the liner having a first protruding portion near an apex of the liner, the liner further having a second, distinct portion having a thickness varying along a length of the second portion, wherein the first protruding portion is selected from the group consisting of a generally nipple-shaped protrusion and a generally conical-shaped protrusion, wherein the second portion has a segment that increases in thickness with radial distance from the apex of the liner, wherein the liner extends from its apex to an end edge, and wherein the segment of the second portion extends from an edge of the first protruding portion to a point proximal the end edge of the liner.

36. The perforating device of claim 35, wherein the second portion has a second segment extending from the point proximal the end edge of the liner to the end edge, the second segment decreasing in thickness with distance from the apex of the liner.

37. The method of claim 18, wherein forming the liner comprises forming the second portion to have a generally concave inner surface and a generally convex outer surface.

38. The method of claim 37, further comprising providing step changes in thickness at different points along the inner surface.

39. The method of claim 38, further comprising providing step changes in thickness at different points along the outer surface.

40. The method of claim 18, further comprising providing step changes in thickness at one or more points along the liner.

* * * * *